US007625324B1

(12) United States Patent
Hinds et al.

(10) Patent No.: US 7,625,324 B1
(45) Date of Patent: Dec. 1, 2009

(54) KEYED HANDGRIP ASSEMBLY

(75) Inventors: Robert Sylvester Hinds, 137 E. Wilson St., Condo 1411 East, Madison, WI (US) 53703; Loyd William Bonneville, Madison, WI (US)

(73) Assignee: Robert Sylvester Hinds, Madison, WI (US)

( * ) Notice: Subject to any disclaimer, the term of this patent is extended or adjusted under 35 U.S.C. 154(b) by 11 days.

(21) Appl. No.: 12/119,523

(22) Filed: May 13, 2008

Related U.S. Application Data

(63) Continuation-in-part of application No. 11/554,357, filed on Oct. 6, 2006, now Pat. No. 7,312,751.

(51) Int. Cl.
*A63B 21/02* (2006.01)

(52) U.S. Cl. ..... 482/126; 482/121

(58) Field of Classification Search ..... 482/121–126, 482/139, 44, 49
See application file for complete search history.

(56) References Cited

U.S. PATENT DOCUMENTS 3,460,829 A * 8/1969 Roggero ..... 482/139
5,336,152 A * 8/1994 Winslow et al. ..... 482/132
5,425,690 A * 6/1995 Chang ..... 482/46
5,665,040 A * 9/1997 Ho ..... 482/126
6,497,641 B1 * 12/2002 Hinds ..... 482/126
6,692,415 B1 * 2/2004 Winston ..... 482/126
6,923,750 B1 * 8/2005 Hinds ..... 482/126
7,163,496 B1 * 1/2007 Trotter ..... 482/126
7,326,157 B2 * 2/2008 Wu ..... 482/126
7,357,762 B1 * 4/2008 Terry et al. ..... 482/126
7,438,669 B1 * 10/2008 Bloom ..... 482/49

* cited by examiner

*Primary Examiner*—Fenn C Mathew
(74) *Attorney, Agent, or Firm*—Craig A. Fieschko, Esq.; DeWitt Ross & Stevens S.C.

(57) ABSTRACT

The handhold of an exercise handgrip turns freely while seated between the open ends of the upwardly extending prongs. It can be easily removed by moving the specially formed end part of the handhold into an access opening wide enough to slip the end part through. In positioning the handhold's end part for this removal, it must be forcibly snapped through a narrow opening. By reversing the procedure, the handhold can easily be returned to its place of rotation. The specially formed end part of the handhold must, therefore, have a narrow neck-like portion to fit through the narrow opening but the end part must also be enlarged to keep it in place for rotation. Preferably, there is also a stem and ball unit in one of the prongs which swings into place to trap exercise sheeting, cord or other media within an opening at the handgrip's bottom portion.

9 Claims, 5 Drawing Sheets

FIG 5
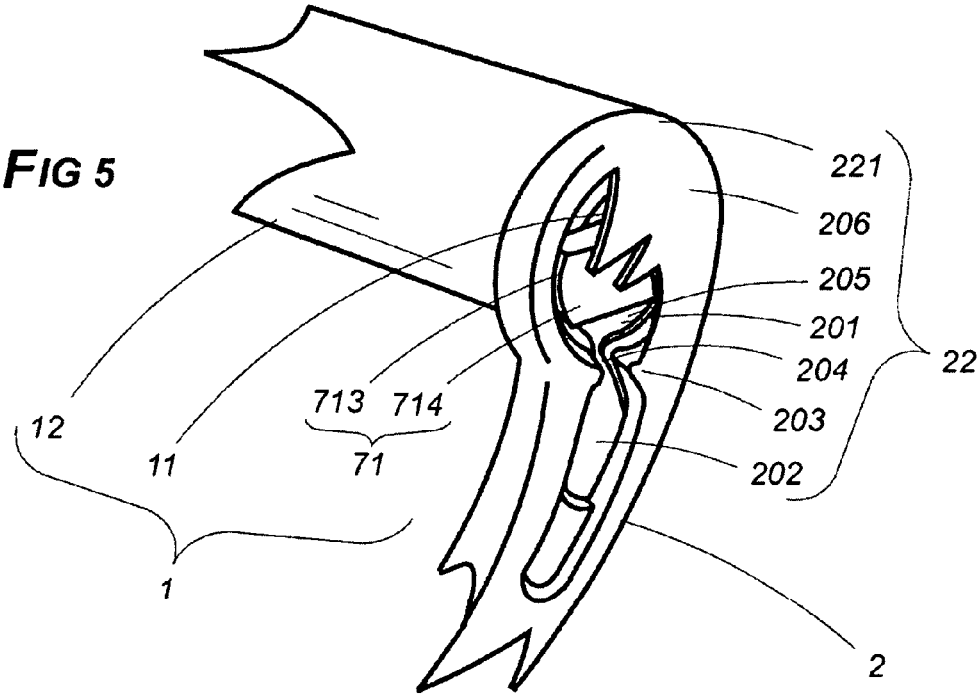
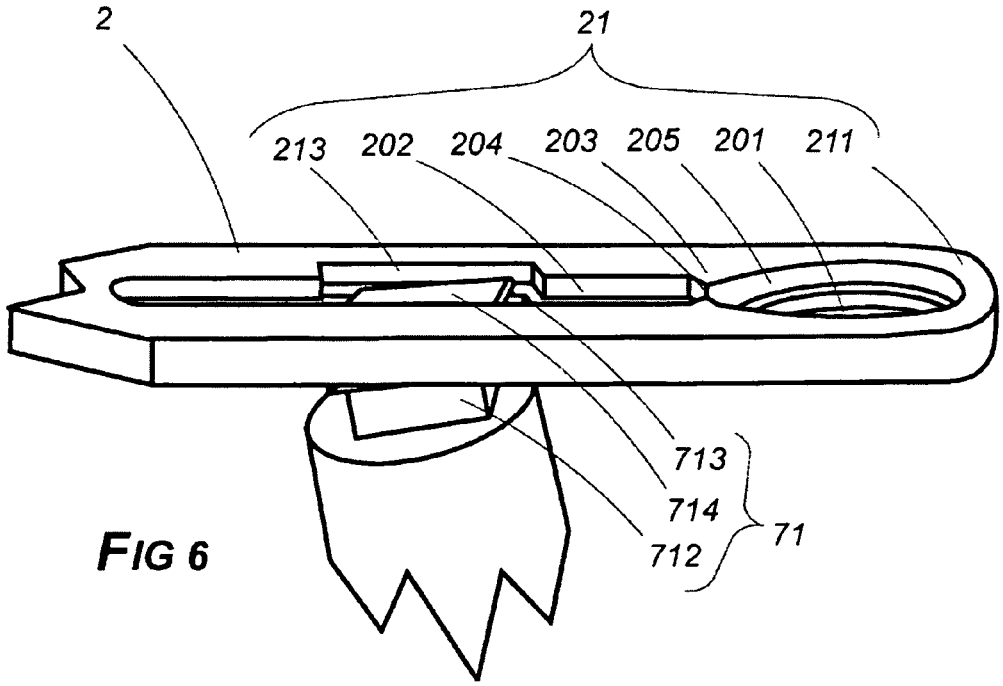
FIG 6

FIG 10
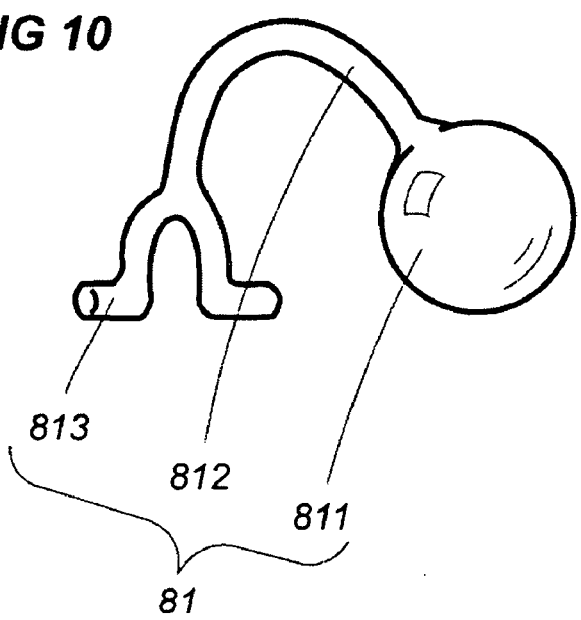
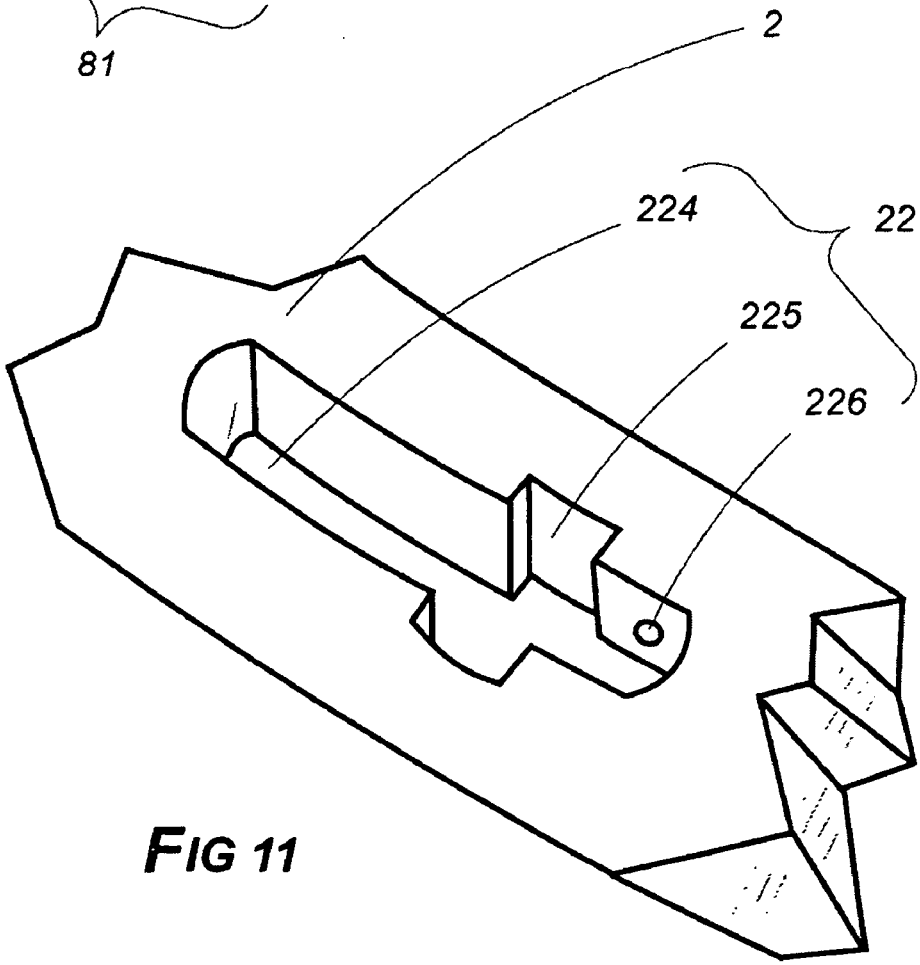
FIG 11

KEYED HANDGRIP ASSEMBLY

CROSS-REFERENCE TO RELATED APPLICATIONS

This instrument, filed under 37 CFR 1.53(b) and 1.78 invoking the provisions of 35 U.S.C. 120, is a Continuation in Part of currently abandoned application Ser. No. 11/544,357 entitled "Retained Impinger for Universal Sports Use", filed Oct. 6, 2006.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Exercise equipment

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term impediment passage constriction (204) might be used in one instance but in another, if meaning is otherwise clear from context, expression might be shortened to passage constriction (204) or merely constriction (204). Any of those forms is intended to convey the same meaning.

The term attach or fasten or any of their forms when so used means that the juncture is of a more or less permanent nature, such as might be accomplished by nails, screws, welds or adhesives. Thus it is stated herein that the innermost end of the axial key stop's intermediate shank (712) is attached to the assembly's handhold core (11). A connection in which an object would be easily removed from another is described by the word emplace as where it is stated that the axial key stop pedestal (71) is emplaced through a prong's key access opening (202). A connection in which two objects, although not attached could be separated only with considerable difficulty is referred to herein as one of rigid emplacement. The forced passage of the key stop pedestal's shank (712) through the pedestal snap-though impediments (203) is stated herein to provide such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the subject matter hereof comprises a special exercise handgrip, meaning that the latter is in fact the former and the former, the latter. The term comprise may also be characterized by what might be considered one-way equivalency, as when it is stated herein that a recess formed in the prong (22) to facilitate the key stop flange's (713) emplacement therein (202) upon angularly tipping the pedestal (71) may comprise the shank entry relief means (223) required for that operation. This use of the word has a generic sense to it. That is, a recess will always be shank entry relief means (223) but shank entry relief means (23) may be a recess in one case but something else-a widened opening, for instance—in another. However, the word comprise may also be used to describe a feature which is part of the structure or composition of a given object. Thus, it is said each handgrip prong (21, 22) may comprise an ensconcement roof (206) as a component thereof (21, 22). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of an object in the manner in which it would be typically oriented for use or viewing. The prongs (916) of a prior art handgrip are, thus, described as upwardly extending and the distal (211, 221) and proximal (212, 222) portions of the handgrip prongs (21, 22) of the subject matter hereof are distinguished as those more upwardly extending and those more downwardly extending. Similarly, it is upon the outermost end of an intermediate shank (712) that a flange (713) comprises an outwardly disposed face (714); and at the outermost portion of the axial conduit (201) and key access opening (202) that a rotation well (205) is disposed. In this same vein, the flange (713) of a certain simple assembly is said to rotate beyond the outermost portion of the respective prong (21, 22) against its (21, 22) outermost surface. These terms of orientation should be interpreted to represent respective aspects or dispositions of members of the assembly in a consistent manner—even if it were, for example, held upside down in certain instances.

The relational phrase disposed in opposition or equivalents thereof such as opposing and oppositely, indicate dual existence and locus, such as references made to handgrip prongs (21, 22), the paired key stop pedestals (71) and respective ends of the core (11).

As indicated, supra, references to proximal and distal address orientation of an object's parts or sectors nearer or farther from, respectively, a given point of origin. For prongs (21, 22, 916) of a handgrip the point of origin would, for example, be their place of juncture—the bottom or curved portion of the "U"-shape, as it were.

The word transverse and variants thereof describe orientation of one object at a right angle to another. Thus, the key pedestal's flange (713) is said to be transversely disposed upon the outward portion of the pedestal's intermediate shank (712). Moreover, certain objects are addressed in terms of transverse dimensions. Such is the case with those of the axial key stop pedestal's face (714) wherein distinctions are made in terms of its (714) length and breadth for purposes of emplacement within the key stop access opening (202) as well as reliable retention within the axial conduit (201). Acknowledging that an object's third dimension also presents a transverse aspect, the word thickness is instead employed to avoid confusion. Accordingly, that dimension of the pedestal's flange (713) is so addressed when referring to the alternative installation procedure, ante, undertaken in tipping it (713) for passage through the access opening (202).

The term axial alignment as used herein refers to a relationship between a point of reference upon a first object with a second configured so as to comprise an axis wherein the first's point of reference is lined up with the axis of the second. The axial conduits (201) of opposing prongs (21, 22)

are, thus, spoken of as being in axial alignment with one another (201), anticipating the installation between them (201) of the handhold's core (11) disposed to turn upon its (11) axis while seated within them (201) for the purpose.

The term sleeved denotes a hollowed configuration wherein a first object houses a second—as exhibited by the sleeved handhold of prior art.

The term exercise "cord", whether stretchable or not, is avoided herein because of the preference in some instances of employing other exercise tethering materials more generically referred to as exercise media-stretchable sheeting, for instance.

Certain words or phrases have been coined as a matter of expression herein. The words rotable and rotability are examples of coining use denoting an object's capability of being turned or pivoted without undue impediment within a seat it is disposed in, as opposed to suggesting a rapidly spinning behavior or some other sort of circular motion which might be addressed by the more cumbersome word rotatable. The term rotably seated similarly describes that phenomena. Enwrapment and related coinage refers to an enveloping enclosure of sorts. Use of the term ensconcement roof (206) as an overlying ceiling to house the axial key stop pedestal (71) refers to its (206) concealing properties and disposition. Snap-through terminology more or less inherently connotes the meaning thereof in referring to the forcible rigid emplacement of an object through or into an opening. This is the case with the passage of the pedestal's shank (712) from the key stop access opening (202) through an impediment passage constriction (204) into the axial conduit (201), a phenomena made possible by the level of resilient composition of the substrate—the prongs (21, 22) in this case—with reference to the constriction's (204) dimensions. Thus, a composition of greater durability would undoubtedly require a slightly wider constriction (204) and one of lesser durability would permit one (204) of narrower dimension.

The phrase communicative conjunction denotes a connection or passageway between two openings. Thus, a prong's key access opening (202) is said to be in communicative conjunction with a respective axial conduit (201), meaning that although certain intervening obstructions might actually be present—as is the case herein—it is feasible to move a given object from one to the other (201, 202).

A long-standing member of prior art history, the stirrup—or solid—handgrip as distinguished, say, from a strapped one—was undoubtedly so named because of its resemblance to the familiar equine riding accessory. In the tradition, there were many with frames (951) forming a one-piece structure which permitted no rotation at all of the handhold integrally unified within it (951). Some time ago, exercise operators wizened by experience learned that conferring rotability upon the handhold core (902) allowed performance of the intended motions without contending with unwanted likely attending factors. Those included either a turning of the handhold core (902) within the palms, necessitating a loosening of the grasp upon it; incidental counterproductive compensating adjustments incurred within some part of the body—the wrists, perhaps; or undue stress upon the media (5) or some other part of the exercise assembly.

Sleeved handhold arrangements emerged but eventually, a handhold core (902) was provided which was set in place between open distal ends of upwardly extending prongs (916)—or limbs, as they were sometimes referred to. Although a considerable number of the ordinary one-piece non-rotary handgrips remained extant, it is probably fair to say that the preferred slightly more expensive variety comprised a handhold core (902) that turned. The prongs (916) merged at their proximal ends to form the familiar "U"-shape in what is designated herein as mutual closure-a convenient term to use when addressing them (916) as independently considered handgrip members. The openness of the prongs and sometimes the handgrip's composition provided a limited degree of resiliency which facilitated emplacement and retention of a rotable core (904). Usually, the rotability was provided by reason of a rotable pin (903) which extended from the core (902) to turn within either sockets (954) or tunnels (955) within the handgrip prongs (916), the latter arrangement sometimes involving attachment of a rotable rivet (981) to hold the core (902) in place. Conversely, the core (902) might have comprised a core socket (904) to accommodate a prong's pin (953) rotably seated therein.

In U.S. Pat. No. 5,505,677 issued to Hinds, a slightly cumbersome longitudinally split metal handhold dedicated to that end was featured with a hinge permitting clamshell halves to mount rotably upon spindles in the frame's prongs (916). Even before that, however, the handhold longitudinally enwrapped by a sleeve, supra, had been in use and, as subsequently demonstrated in U.S. Pat. No. 6,217,494 B1 issued to Sandoval, the sleeves could be mounted upon a kind of crankshaft to achieve even greater rotary movement. An assembly was also presented in U.S. Pat. No. 6,342,032 B1 issued to Affield which adopted the rudimentary and even more ancient rotary bolt and nut combination but which also featured operation around a non-parallel additional axis. Finally, in U.S. Pat. No. 6,398,698 B1 issued to Hinds, a rotable handhold which could be snapped in place within the stirrup was provided which turned very freely within its mount. None of those were removable with any degree of convenience, however, a screwdriver was required to pry loose the core (902) of the snap-in-place Hinds model. It was likely intended that handhold be installed only once—at the factory. Even the earlier Hinds' longitudinally hinged metal grip, probably otherwise very easy to open along its hinge, was shrouded with an interfering cylindrically configured padded sheath which (12), it had to be anticipated, would eventually require replacement due to wear. Moreover, occasionally, although, perhaps not very often—a broken handgrip frame itself (951) or core (102) might have needed replacement. Applicant believes the market would benefit by provision for a stirrup handgrip frame (951) of an easily removable securely retained rotable handhold.

While the prior art has made some strides along those lines, certain features yet remain to be provided to fulfill the expectations of the avid exerciser.

BRIEF SUMMARY OF THE INVENTION

A handgrip (1) similar in many respects to the solid or stirrup model of prior art additionally comprises certain openings at the ends of the prongs (21, 22) which connect with one another to accommodate a keyed rotable handhold core (11). The core itself (11) is specially shaped, having at each end thereof (11) a protruding axial key stop pedestal (71) comprising certain parts shaped for insertion through a key access opening (202) in each prong (21, 22). Once so emplaced, the pedestal (71) is forcibly snapped through an impediment passage constriction (204) and into an axial conduit (201) situated near the prongs' distal ends (211, 221). The manner in which the newly formed components—the prong openings (201, 202) and the axial key stop pedestal (71) are configured characterizes the pedestal's (71) forced passage through the pedestal snap-through impediments (203) as one of rigid emplacement while facilitating its (71) interconnection within the prong's axial conduit (201) to complete the structure of the handgrip as a whole.

The key stop pedestal (71) is configured to comprise as members thereof (71) an intermediate shank (712), or neck-like extension; and transversely oriented with respect to it (712), a flange (713) comprising an outwardly disposed face (714). The dimensions of the shank (712) and flange's face (714) are such that the pedestal (71) comprising them (712, 714, respectively) is free to rotate within the axial conduit (201) without risk of the flange's (713) being pulled back through the conduit (201) during operation.

The cross-sectional dimensions of the intermediate shank (712) are also important to provide proper snap-fit installation into the axial conduit (201) as well as to assure reliable retention therein (201), once so positioned.

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A heavily framed outline of a portion of the drawing is representative of a number of specific variations of the more generic feature it symbolically identifies.

FIG. 5 illustrates in cut-away a portion of the assembly comprising an ensconcement roof (206).

FIG. 6 illustrates in cut-away the distal end (221) of what is herein designated a second handgrip prong (22) comprising shank entry relief means (223) accommodating the flange (713) of a manually tipped handhold core's axial key stop pedestal (71).

FIG. 10 illustrates an exemplary impinger (81) including a head (811), stem (812), and pivot-anchor (813).

FIG. 11 illustrates a section of an extending prong (22) of a handgrip frame (2), with the section bearing an impinger clearance opening (224), impinger access notch (225), and pivot-anchor receptacle (226).

DETAILED DESCRIPTION OF THE INVENTION

Figure 1:
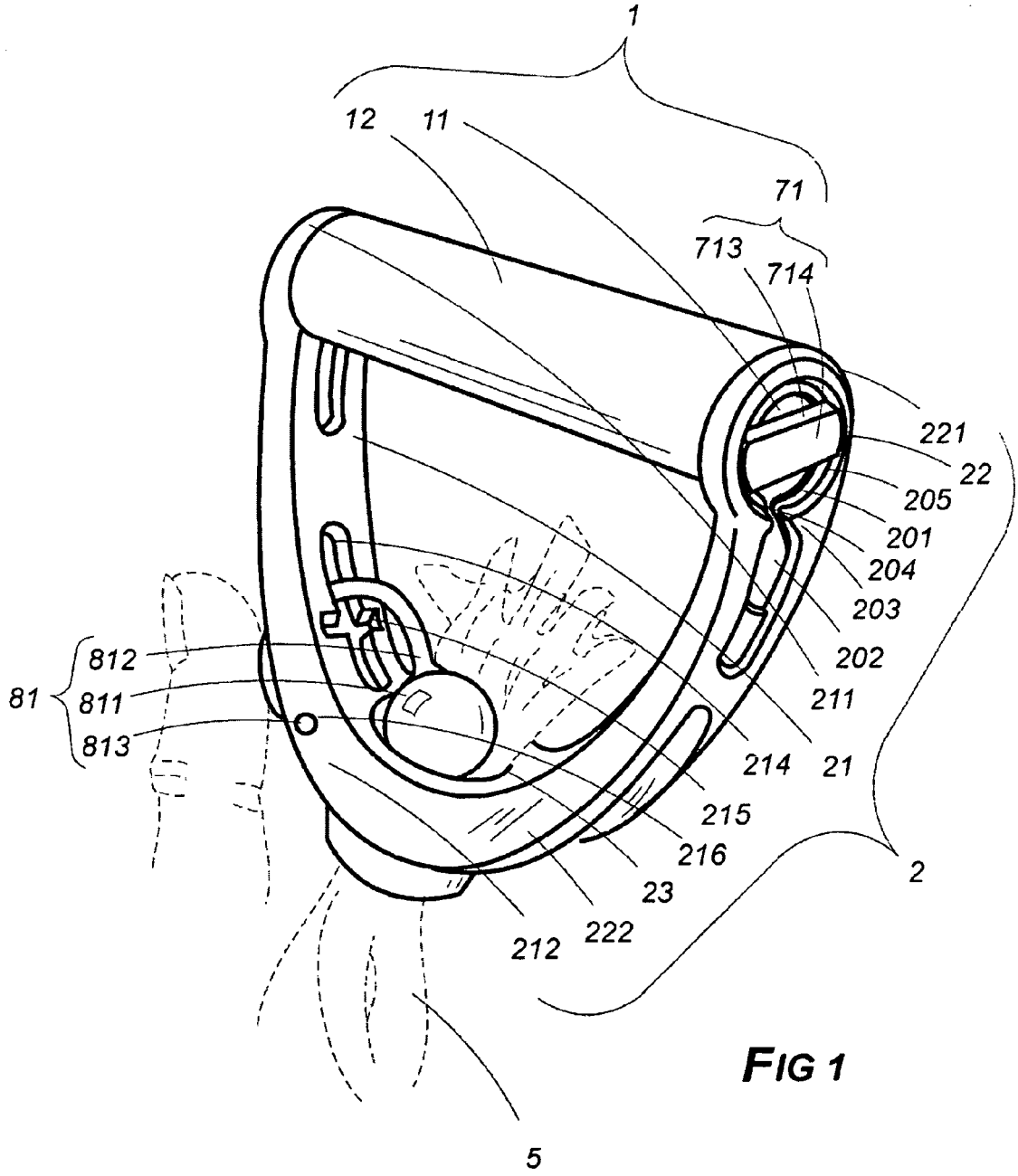
FIG. 1 is a perspective view of a preferred version of the keyed handgrip comprising, as part thereof, a pivoted media impinger (81).
Figure 2:
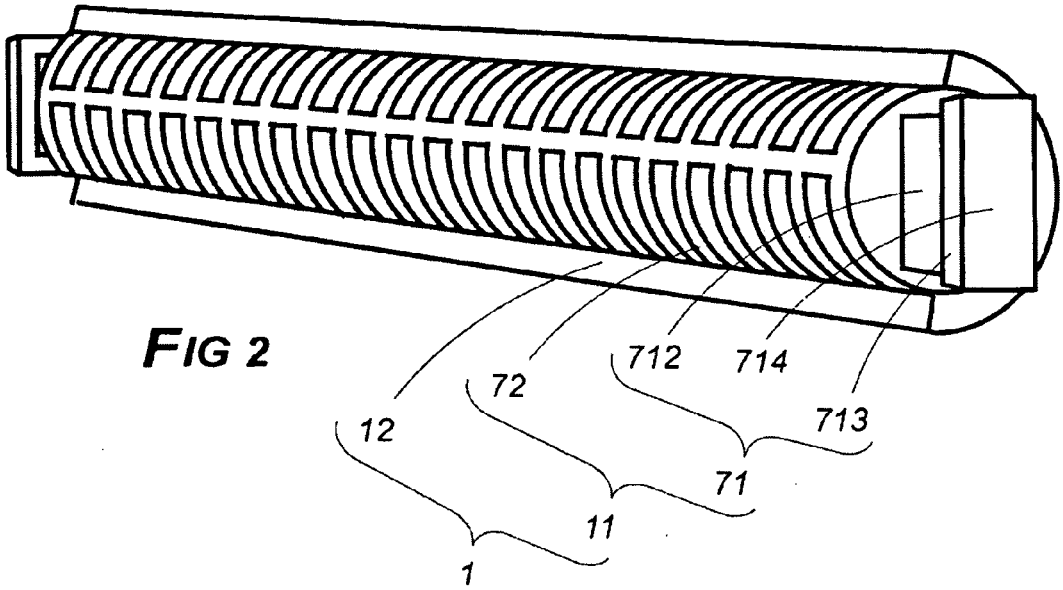
FIG. 2 depicts in cut-away the keyed handhold (1) comprising numerous molding vanes (72).
Figure 3:
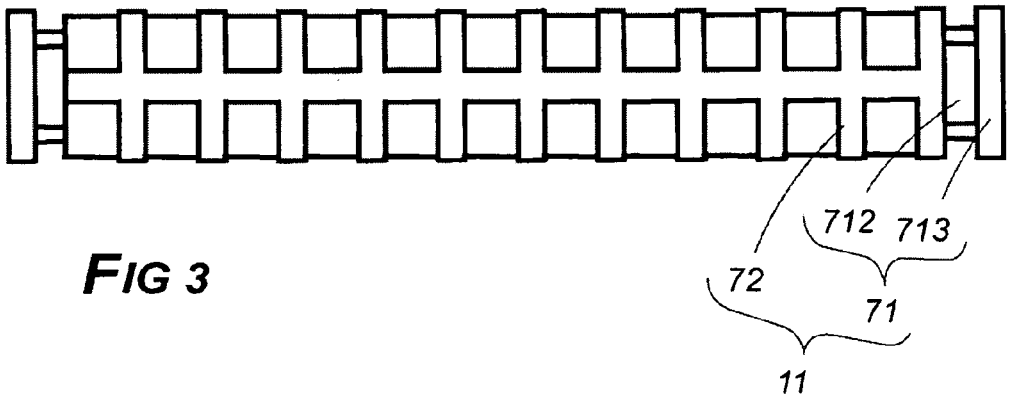
FIG. 3 illustrates a front-on view of a preferred version of a multiply vaned (72) handhold core (11) turned to show the maximum vertical dimension of a horizontally oriented axial key pedestal (71).
Figure 4:
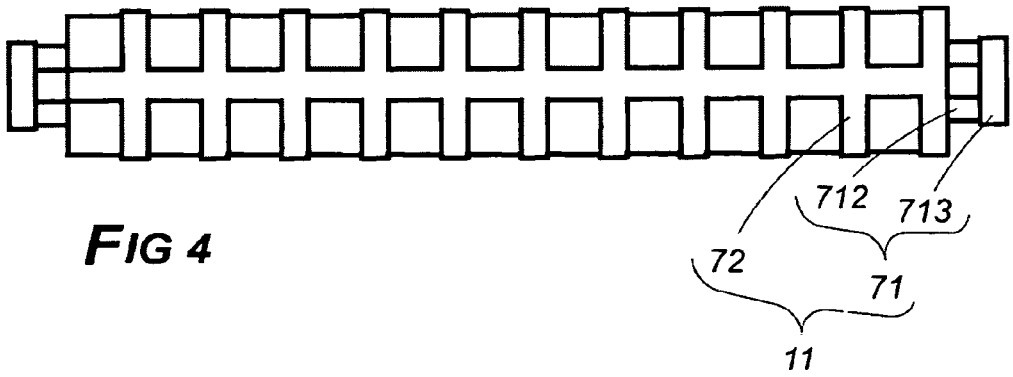
FIG. 4 represents the same handhold (1) rotated upon its longitudinal axis to show the minimum vertical dimension of the same rectangularly flanged pedestal (71).
Figure 7:
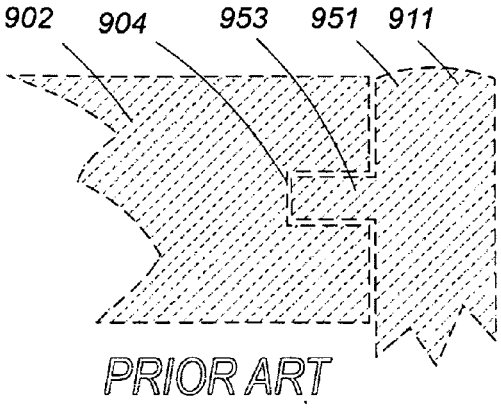
FIGS. 7-9 illustrate in cut-away connection mechanisms for common prior art handgrip prong (911)-core (902) combinations.
Figure 8:
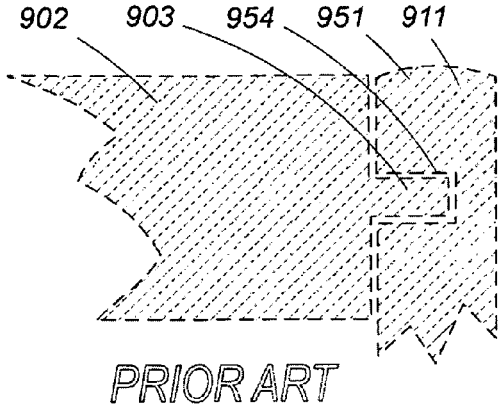
Figure 9:
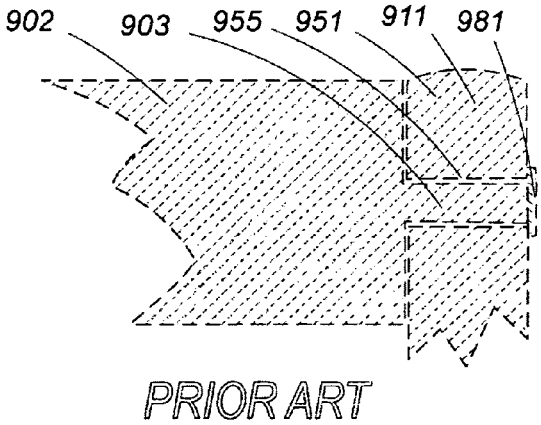

The subject matter hereof comprises a special exercise handgrip comprising in combination two interconnecting parts—the first, a handgrip frame (2)—the usually "U"-shaped part of a solid or stirrup handgrip; the second, a keyed handhold (1).

The handgrip frame (2) comprises in part first and second opposing extending prongs (21, 22, respectively).

The keyed handhold (1) comprises a generally elongated handhold core (11) in turn comprising paired axial key stop pedestals (71) which are oppositely disposed—that is, one at each end thereof (11). Each pedestal (71) is configured to comprise an intermediate shank (712) disposed at the innermost end thereof (712) in what is herein designated axial attachment to and extension from an end of the core (11). Each pedestal (71) further comprises transversely disposed upon the outermost end of its intermediate shank (712) a flange (713) in turn comprising an outwardly disposed face (714).

The prongs (21, 22) of the handgrip frame (2) are separately considered in terms of their ends. Thus, the first prong's distal and proximal ends are (211 and 212, respectively) and those of the second prong, (221 and 222) extend upwardly in the familiar manner observed of the paired prongs (916) of prior art. As in the art, the two prongs (21, 22) of the subject matter hereof meet in general handgrip construction directed at their proximal ends (212, 222, respectively) in what is denominated herein as mutual closure, supra. However, the traditional "U-" shape for the handgrip frame (2), while preferred, is not insisted upon herein, since it is conceivable those ends (212, 222) would not necessarily merge in that same manner in other possible exercise arrangements employing the keyed handhold concept hereof.

Each extending prong (21, 22) comprises an axial conduit (201) disposed proximate its distal end (212, 222) in axial alignment with that (201) of the opposing prong (22, 21); and further comprises a key access opening (202) in communicative conjunction, as that term is defined herein, with the respective axial conduit (201).

Each extending prong (21, 22) is also stated to comprise one or more pedestal snap-through impediments (203) disposed between the axial conduit (201) and the key access opening (202) to form an impediment passage constriction (204) of size and configuration offering resistance to the passage of the pedestal's intermediate shank (712) therethrough except upon application of a sufficient level of force. That is, the impediment passage constriction (204) is narrower than the key stop pedestal's shank (712) but, nevertheless, large enough such that, by reason of the prongs' (21, 22) resilient composition and configuration, the shank (712) may be forcibly snapped therethrough (204).

The axial conduit (201) comprises cross-sectional dimension large enough to permit the pedestal's intermediate shank (712) to rotate freely therein (201).

The widest dimension of the face (714) of each flange (713) is greater than the diameter of the respective axial conduit (201). Such configuration prevents the flange (713) from being pulled through the conduit (201) during exercise. Although the narrowest dimension of the face (714) may comprise width less than the axial conduit's (201) diameter without encountering that risk, it is preferred for the sake of enhanced security that all of the face's (714) dimensions exceed the diameter of the conduit (201).

In some versions of the assembly, the widest dimension of the pedestal's face (714) is narrower than the prong's key access opening (202). This arrangement expedites emplacement through the opening (202) without affecting security within the axial conduit (201). In a preferred version, however, the access opening (202) is wider than the face's (714) narrowest dimension but narrower than its (714) widest. To that end, it must be assured that the composition of the handgrip be semi-rigid—flexible enough for its prongs (21, 22) to be bent slightly to install the core but sufficiently rigid to prevent the core's pedestal (71) from being drawn back through the axial conduit (201).

The intermediate shank (712) comprises length relative to depth of the axial conduit (201) such that upon installing the handhold core (11) between the handgrip's prongs (21, 22), the respective key stop pedestal (71) and, therefore, the core (11)—is disposed to rotate freely with security. In a simple arrangement of the assembly, the shank (712), thus, extends through the respective extending prong (21, 22) such that upon installation between them (21, 22), the handhold (1) is free to rotate unobstructed, the flange (713) rotating beyond the outermost portion of the respective prong (21, 22), preferably rotably seated against its (21, 22) outermost surface.

In a much preferred version of the assembly, each prong (21, 22) comprises at the outermost portion of and in communicative conjunction with the axial conduit (201) and key access opening (202), a rotation well (205) wherein the key stop pedestal's flange (713) is rotably seated. This arrangement disposes the flange (713) more securely and helps streamline the handgrip's contour. It is also feasible to comprise the well (205) with a capped exterior to more securely enclose the flange (713) beneath it and further streamline the assembly. To those ends, the prong (21, 22) may be configured to comprise an integrally disposed ensconcement roof (206).

The assembly preferably comprises a pivoted media impinger (81) in turn comprising its familiar components, the impinger's head (811), its stem (812) and its pivot-anchor (813). The pivot-anchor (813) is disposed in either prong (21, 22). The stem (812) is attached to the pivot-anchor (813) and the head (811) is attached to the stem (812). The configuration is such that the stem is caused to pivot in an arc which disposes the head into the handgrip frame's media tunnel (955) to permit length adjusting impingement of the exercise media extending therethrough (955). Preferably, there is also present in the respective prong (21, 22) a clearance opening (224) through which protrudes a portion of the stem (812) which the operator can push against with his or her thumb to urge the impinger assembly (81) to swing inward.

Finally, the handhold (1) connective portion of the prongs (21, 22) may be configured—with reference to the keyed feature—differently from one another (21, 22) wherein the first prong (21) comprises any or all of the various features hereinbefore addressed and the second prong's (22) key access opening (202) comprises width smaller than the narrowest dimension of the pedestal flange's face (714) but large enough to accommodate passage of the flange's (713) given thickness permitting entry through the access opening (202) when angularly tipped for entry therein. In an assembly of this sort, the flange (713) at one end of the core (11) is tipped to slide it (713) through an access opening (202) configured with shank entry relief means (223) to allow the entirety of the flange (713) to slip through. Either a recess formed in the prong (22) or merely a sufficiently width of that portion of the opening (202) may comprise the means (223) required for the pedestal's entry therein (202). By reason of the prongs' (21, 22) inherent flexibility, the flange (713) at the opposing end of the core (11) is easily installed in the usual straight-forward manner through the key access opening (202) of the first prong (21).

The invention claimed is:

1. A keyed handgrip assembly comprising
a keyed handhold; and
a solid handgrip frame comprising opposing extended first and second prongs in turn comprising given resilient composition and configuration;
the keyed handhold comprising
a generally elongated handhold core in turn comprising oppositely disposed paired axial key stop pedestals;
each key stop comprising a pedestal in turn comprising
an intermediate shank disposed at its inner end in axial attachment to and extension from the end of the handhold core;
a flange transversely disposed upon the outer end of each intermediate pedestal shank and comprising an outwardly disposed face;
each extending prong comprising
a distal end and a proximal end;
an axial conduit;
a key access opening disposed therein in communicative conjunction with the axial conduit; and
one or more pedestal snap-through impediments;
the prongs' proximal ends directed in mutual closure in a fashion providing general handgrip construction;
each prong's axial conduit disposed proximate its distal end in axial alignment with that of the opposing prong and comprising cross-sectional dimension large enough to permit the shank to rotate freely therein;
each prong's pedestal snap-through impediment configured with protrusions disposed between the axial conduit and the key access opening to provide a passage constriction narrower than the key stop pedestal's shank but, nevertheless, large enough such that, by reason of the prong's resilient composition and configuration, the shank may be forcibly snapped therethrough; the flange configured such that its face's widest dimension is greater than the diameter of the axial conduit such that it cannot be pulled through;
the shank comprising length relative to the axial conduit such that upon installing the handhold core between the handgrip's prongs, each key stop pedestal is disposed to rotate freely with security.

2. The keyed handgrip assembly according to claim 1 wherein the fashion in which the prongs' proximal ends dispose an exercise cord tunnel at the juncture thereof; and a pivoted media impinger in either of the prongs;
the pivoted media impinger comprising:
a head;
a stem; and
an pivot-anchor disposed within the respective prong;
the stem disposed by attachment to the pivot-anchor and the head disposed by attachment to the stem; such that the stem is caused to pivot in an arc which disposes the head into the media tunnel to permit length adjusting impingement of exercise media extending therethrough.

3. The keyed handgrip assembly according to claim 2 wherein the prong's access opening is wider than the narrowest dimension of the face.

4. The keyed handgrip assembly according to claim 2 wherein the prong's access opening is wider than the widest dimension of the face.

5. The keyed handgrip assembly according to claim 2 wherein each extended prong additionally comprises a rotation well disposed outwardly from and in communicative conjunction with the respective prong's axial conduit and key access opening; the rotation well comprising a rotation shoulder therein disposing the rotation well of cross-sectional dimension greater than that of the axial conduit;
the axial key stop pedestal's flange configured such that its face's widest dimension is less than that of the rotation well;
wherein, upon installing the handhold core between the handgrip's prongs, each key stop's flange is free to rotate unobstructed within the respective rotation well.

6. The keyed handgrip assembly according to claim 2 wherein the axial key stop pedestal's flange additionally comprises given thickness; and the first prong's key access opening comprises width smaller than the narrowest dimension of the pedestal flange's face but wide enough to accommodate passage of the flange's given thickness angularly tipped for entry therein; wherein the handhold core may be expediently connected to the first prong before securely connecting it to the second prong.

7. The keyed handgrip assembly according to claim 2 wherein the intermediate shank comprises an axial cross-section of narrowed dimension and a transversely oriented widened dimension, thereby evincing rectangular cross-sectional configuration.

8. The keyed handgrip assembly according to claim 2 wherein each extending prong comprises an ensconcement roof disposed outwardly from the key stop pedestal in an overlying manner so as to protect the pedestal from damage and conceal it for streamlined effect.

9. The keyed handgrip assembly according to claim 2 wherein the keyed handhold additionally comprises a padded sheath.

* * * * *